US005445272A

United States Patent [19]

Crisp

[11] Patent Number: 5,445,272

[45] Date of Patent: Aug. 29, 1995

[54] COLOR CODED PAKAGING DISPLAY SYSTEM

[75] Inventor: Kelvin E. Crisp, Roanoke, Va.

[73] Assignee: Hubbell Incorporated, Orange, Conn.

[21] Appl. No.: 280,996

[22] Filed: Jul. 27, 1994

[51] Int. Cl.[6] ..... B65D 85/42; B65D 73/00

[52] U.S. Cl. ..... 206/459.5; 206/419; 206/321

[58] Field of Search ..... 206/459.5, 321, 419, 206/534, 320, 373, 372, 378, 576; 211/71

[56] References Cited

U.S. PATENT DOCUMENTS

| | | | |
|---|---|---|---|
| 1,358,415 | 10/1920 | Cahusac | 211/71 |
| 1,700,976 | 2/1929 | Bulman | 211/71 |
| 1,952,478 | 3/1934 | Stine | 206/459.5 X |
| 2,082,214 | 6/1937 | Osten | 211/71 |
| 3,804,238 | 4/1974 | Howard | 206/372 X |
| 3,910,412 | 10/1975 | Vargo | 206/459 |
| 4,815,610 | 3/1989 | Borick et al. | 211/59.1 |
| 4,874,084 | 10/1989 | Strausser | 206/459.5 X |
| 4,903,836 | 2/1990 | Combs | 206/419 |
| 4,936,170 | 6/1990 | Zometa | 206/459.5 X |
| 5,005,705 | 4/1991 | Combs | 206/419 X |
| 5,051,870 | 9/1991 | Companion | 361/405 |
| 5,361,904 | 11/1994 | Kapec et al. | 206/459.5 X |

FOREIGN PATENT DOCUMENTS 2453714 5/1976 Germany .

*Primary Examiner*—Steven N. Meyers
*Assistant Examiner*—Tara L. Laster
*Attorney, Agent, or Firm*—Jerry M. Presson; Mark S. Bicks

[57] ABSTRACT

A packaging display system includes a first set of cartons packaging a first group of products and a second set of cartons packaging a second set of products. Each of the sets and groups are divided into subsets and sub-groups. The products of the first group are selectively matable with the products of the second group, with only some of the first sub-groups products properly mating with only some of the second sub-group products but not with other products of the second sub-groups. Color coding is provided on the cartons for indicating which of the products of the first; sub-groups properly mate with the second sub-group products. The color coding includes patches of different colors with a same color patch appearing on the cartons of the first and second sub-groups packaging products of the first and second sub-groups which properly mate.

14 Claims, 2 Drawing Sheets

COLOR CODED PAKAGING DISPLAY SYSTEM

FIELD OF THE INVENTION

The present invention relates to a color coded or coordinated packing display system for selectively matable products or parts. More specifically, the present invention involves providing patches of the same color on the cartons of at least two groups of products to indicate which of the respective products of each group will properly mate with the respective products of the other group.

BACKGROUND OF THE INVENTION

Certain assemblies of interchangable parts are marketed such that the purchaser can select the desired and proper combination of parts. Groups of such parts or products often must be mated to each other wherein only certain products of the first group will mate with only certain products of the second group. Cartons for packaging these groups of products must clearly and efficiently indicate the limited mating capabilities of the various products.

Conflicting interests in solving this problem exist when the products are packaged and displayed in single manner for professional users such as contractors, as well as for do-it-yourself consumers. The contractors need only a low cost package. The do-it-yourself consumers need a package which communicates details of the application and installation of the product and which minimizes potential selection errors to the .greatest extent possible. These conflicting interests are particularly acute for lighting fixtures, particularly recessed lighting fixtures, and the trims therefor.

Many manufacturers of lighting fixtures use different packaging formats for professional contractors and do-it-yourself consumers. However, using different packages requires an excessive use of display and storage space. For recessed lighting fixtures, different housings are provided for those having an insulated ceiling (IC) rating, those not having an insulated ceiling rating, those for low voltage, those for fluorescent lighting and those for a unipack non-insulated ceiling ratings. Additionally, different sizes are indicated by the diameter of the opening in the housing and trim. Each housing and each trim are provided with a model number. The cartons for the trims indicate which housing model numbers are acceptable for providing a proper mating fit. Similarly, the cartons for the housings indicate the model numbers of the trims providing an acceptable mating fit.

Since not all housings mate with all trims, care must be exercised in selecting a combination of a housing and a suitable trim to obtain a usable and proper assembly of the two different products. Significant inconvenience to the consumer and to the retailer is experienced when improper selections are made of incompatible housings and trims.

SUMMARY OF THE INVENTION

An object of the present invention is to provide a packaging display system providing a color coding or coordination between two groups of products to indicate which of the respective products of each group will properly mate with the respective products of the other group.

Another object of the present invention is to provide a packaging display system having color-coded cartons which are low cost and which indicate which of the two groups of products located in the two sets of cartons properly mate.

A further object of the present invention is to provide a packaging display system for lighting fixtures wherein the cartons for the different lighting fixture housings and the cartons for the different trims for the lighting fixture housings have color-coded or color coordinated patches to indicate which of the housings properly mate with which of the different trims.

The foregoing objects are basically obtained by a packaging system comprising a display rack, first and second sets of cartons and first and second groups of products respectively packaged in those cartons. The display rack includes a plurality of shelves. The first set and first group are divided into respective first subsets and first sub-groups. The second set and second group are divided into respective second subsets and second sub-groups. The products of the first group are selectively matable with the products of the second group wherein only some of the products of the first sub-groups properly mate with only some of the products of the second sub-groups and do not mate with other products of said second sub-groups. Color coding means are provided on the cartons for indicating which products of the first sub-groups properly mate with which products of the second sub-groups. The color coding means includes patches of different colors with a same color patch appearing on the cartons of the first and second subsets packaging products of the first and second sub-groups, respectively, which properly mate.

The foregoing objects are also basically obtained by a packaging system for lighting fixtures comprising first and second sets of cartons. The first set of cartons packages different lighting fixture housings and are divided into first subsets for each of the different lighting fixture housings. The second set of cartons packages different trims for the lighting fixture housings and is divided into subsets for each of the different trims. The trims are selectively matable with the lighting fixture housings wherein only some of the lighting fixture housings properly mate with only some of the trims and do not mate with others of said trims. Color coding means on the cartons indicate which of the lighting fixture housings properly mate with which of the trims. The color coding means includes patches of different colors with a same color patch appearing on the cartons of the first and second subsets packaging the lighting fixture housings and the trims, respectively, which properly mate.

By forming the cartons with this color coding or color coordinating arrangement, the purchaser, whether professional or general consumer, can readily determine which products of one group properly mate with which of the products of the other group. Specifically, and for example, once the housing is selected the purchaser notes the color patch on the housing. The purchaser can then choose easily among the various acceptable trim cartons packages that have the same color patch as the lighting fixture housing carton.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
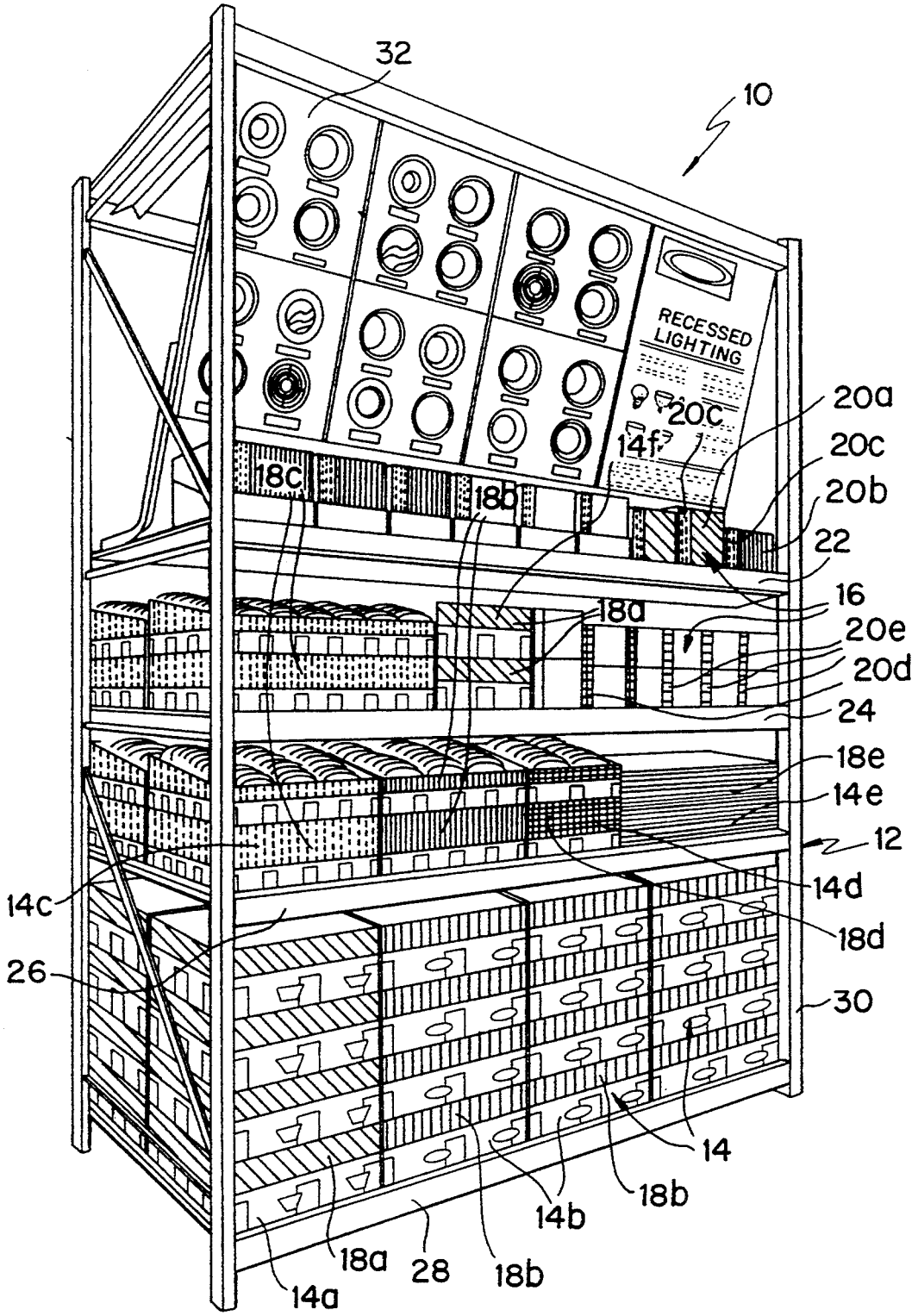
FIG. 1 is a prospective view of a packaging display system according to the present invention.
Figure 2:
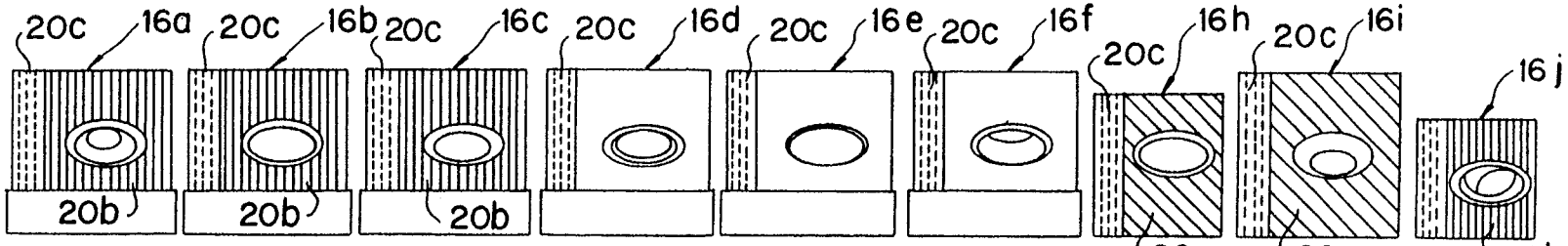
FIG. 2 is a front elevational view of cartons on the first shelf of the display rack of FIG. 1.
Figure 3:
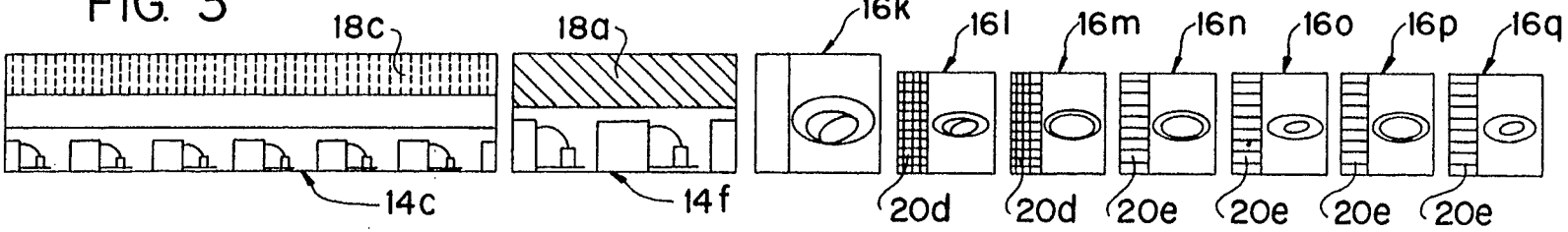
FIG. 3 is a front elevational view of cartons on the second shelf of the display rack of FIG. 1.
Figure 4:
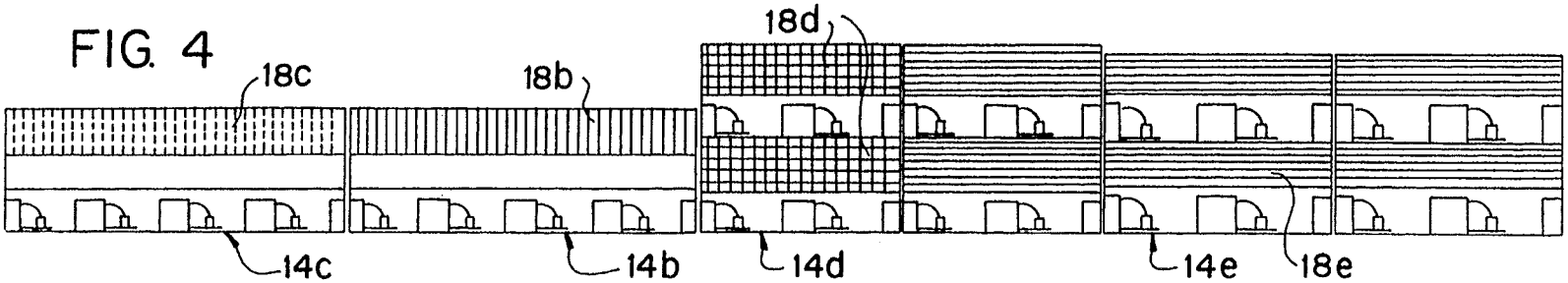
FIG. 4 is a front elevational view of cartons on the third shelf of the display rack of FIG. 1.
Figure 5:
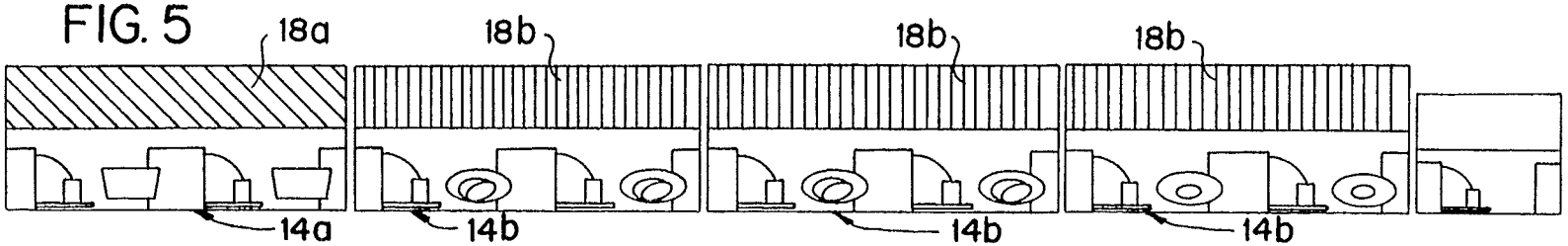
FIG. 5 is a front elevational view of cartons on the fourth shelf of the display rack of FIG. 1.

Referring initially to FIG. 1, the present invention relates to a packaging display system which is particularly suitable and effective for lighting fixtures. The system includes a display rack 12 which supports first and second sets of cartons 14 and 16, respectively. In the illustrated embodiment, the first set of cartons contain different recessed lighting fixtures, while the second set of cartons contain different trims for the lighting fixture housings. Each of the trims is selectively matable with only some of the lighting fixture housings such that only some of the lighting fixture housings properly mate with only some of the trims and do not mate with others of the trims.

Color coding or coordinating means 18*a–e* and 20*a–e* are provided on the cartons for indicating which of the lighting fixture housings properly mate with which of the trims. The color coding or coordinating means includes patches of different colors on the cartons. Patches of the same color appear on ,cartons of selective ones of the first set of cartons and of the second set of cartons which package lighting fixture housings and trims, respectively, which properly mate.

Colored patches 18*a*, 18*b*, 18*c*, 18*d* and 18*e* of different colors appear on first set of cartons 14. Colored patches 20*a*, 20*b*, 20*c*, 20*d* and 20*e* appear on the second set of cartons 16. Patches 18a are the same color (green) as patches 20*a*. Patches 18*b* are the same color (red) as patches 20*b*. Patches 18*c* are the same color (purple) as patches 20*c*. Patches 18*d* are the same color (yellow) as patches 20*d*. Patches 18*e* are the same color (blue) as patches 20*e*.

Display rack 12 comprises a plurality of shelves 22, 24, 26 and 28. The shelves are supported in a conventional manner by a frame 30. Above top shelf 22, a chart 32 is supported. Chart 32 illustrates the different trims contained within the cartons mounted on the rack as well as other pertinent information relating to the recessed lighting fixtures and parts therefor.

The first set of cartons house a first group of products, which in the illustrated embodiment are recessed lighting fixture housings. The cartons are divided in subsets 14*a*, 14*b*, 14*c*, 14*d* and 14*e* for each of five different lighting fixture housings, forming sub-groups of the first group products.

The second set of cartons package different trims for the lighting fixtures to provide a second group of products. Each of the different trims forms a second subgroup of products.

In this manner, the first set of cartons are divided into subsets 14*a*–14*f*. The second set of cartons are divided into subsets 16*a*–16*q*. Each of the sub-groups lighting fixture housings and trims therefor are different in style and/or size.

The configurations of the recessed lighting fixture housings and trims are conventional, and thus, are not described in detail. Graphic illustrations of these housings and trims appears on the illustrated representations appearing in FIGS. 2–5. Suitable examples of these lighting fixtures are illustrated and described in detail in U.S. Pat. No. 2,518,936 to Roberts, U.S. Pat. No. 3,099,404 to Kaufman et al, U.S. Pat. No. 3,381,123 to Docimo, U.S. Pat. No. 3,590,241 to Docimo, U.S. Pat. No. 3,683,173 to Guth, U.S. Pat. No. 3,801,815 to Docimo, U.S. Pat. No. 4,520,436 to McNair et al, U.S. Pat. No. 4,729,080 to Fremont et al, and U.S. Pat. No. 5,075,831 to Stringer et al, the subject matters of each of which is hereby incorporated by reference.

In the color coding system of the present invention, by way of example, the color red can indicate an insulated ceiling (IC) rating; purple indicates a non-IC rating, blue indicates low voltage, green indicates fluorescent and yellow indicates a unipack which is non-IC rating. Additionally, large numbers appear on each carton, for example, 4", 7", etc. to indicate the housing or trim aperture. Each carton also bears its own model number, as well as the model numbers of the housings or trims, as appropriate, with which each is suitably matable.

As most clearly illustrated in FIGS. 2–5, cartons 14*a* have a green patch 18*a*; cartons 14*b* have a red patch 18*b*; cartons 14*c* have a purple patch 18*c*; cartons 14*d* have a yellow patch 18*d*; cartons 14*e* have a blue patch 18*e*; and cartons 14*f* have a green patch 18*a*.

For the second group of cartons, cartons 16*a*, 16*b* and 16*c* each have a purple patch 20*c* and a red patch 20*b*; cartons 16*d*, 16*e* and 16*f* each have only a single purple patch 20*c*; cartons 16*h* and 16*i* each have a purple patch 20*c* and green patch 20*a*; cartons 16*j* and 16*k* each have a purple patch 20*c* and a red patch 20*b*; cartons 161 and 16*m* each only have yellow patches 20*d*; and cartons 16*n*, 16*o*, 16*p* and 16*q* each only have blue patches 20*e*.

The lighting fixture housings and the trims therefore can be suitably matched by matching the sizes and color. For example, the trims in carton 16*a*, 16*b* and 16*c* can be used with the lighting fixture housings in cartons 14*c* or 14*b*, but could not be used with the lighting fixture housing in carton 14*f*. Similarly, the lighting fixture housing in carton 14*d* can only be used with the trims in cartons 161 and 16*m*, but not with any of the trims in the other cartons of the second set 16.

With the color coding or coordinating system of the present invention, the trim and the housing can be matched quickly. Trims that mate with multiple housings are appropriately marked with multiple colors to indicate such multiple mating capabilities. The packaging display enables the retailer to provide an expanded product mix in the lowest possible shelf space, and with an easily understandable key or system to provide correct matchings with minimum chance of error.

While an particular embodiment has been chosen to illustrate the invention, it will be understood by those skilled in the art that various changes and modifications can be made therein without departing from the scope of the invention as defined in the appending claims.

What is claimed is:

1. A packaging display system comprising:

a display rack including a plurality of shelves;

a first set of cartons on at least one of said shelves packaging a first group of products, said first set and said first group being divided into respective first subsets and first sub-groups;

a second set of cartons on at least one of said shelves packaging a second group of products, said second set and said second group being divided into respective second subsets and second sub-groups, said products of said first group being selectively matable with said products of said second group wherein only some of said products of first sub-groups properly mate with only some of said products of said second sub-groups and do not properly mate with other products of said second sub-groups; and color coding means on said cartons for indicating which products of said first sub-groups properly mate with which products of said second sub-groups, said color coding means including patches of different colors with a same color patch appearing on said cartons of said first and second subsets packaging products of said first and second sub-groups, respectively, which properly mate.

2. A packaging display system according to claim 1 wherein each of said cartons of said first set have only one of said patches, said cartons of different first subsets having said patches of different colors; and each of said cartons of said second set have at least one of said patches.

3. A packaging display system according to claim 2 wherein some of said cartons of said second set have at least two patches of two different colors matching patches of two different ones of said first subsets.

4. A packaging display system according to claim 1 wherein said first and second sets of cartons are positioned on different respective shelves of said rack.

5. A packaging display system according to claim 1 wherein said products of said first group comprise different lighting fixture housings; and said products of said second group comprise different trims for said lighting fixture housings.

6. A packaging display system according to claim 5 wherein said lighting fixture housings and trims form recessed lighting fixtures.

7. A packaging display system according to claim 5 wherein a chart illustrating said trims is mounted above said shelves.

8. A packaging display system for lighting fixtures comprising:

a first set of cartons packaging different lighting fixture housings, said first set being divided into first subsets for each of said different lighting fixture housings;

a second set of cartons packaging different trims for said lighting fixture housings, said second set being divided into second subsets for each of said different trims, said trims being selectively matable with said lighting fixture housings wherein only some of said lighting fixture housings properly mate with some of said trims and do not properly mate with others of said trims; and color coding means on said cartons for indicating which of said lighting fixture housings properly mate with which of said trims, said color coding means including patches of different colors with a same color patch appearing on said cartons of said first and second subsets packaging said lighting fixture housings and said trims, respectively, which properly mate.

9. A packaging display system according to claim 8 wherein each of said cartons of said first set have only one of said patches said patches and thereof have different colors; and each of said cartons of said second set have at least one of said patches.

10. A packaging display system according to claim 9 wherein some of said cartons of said second set have at least two patches of two different colors matching patches of two different ones of said first subsets.

11. A packaging display system according to claim 8 wherein a rack supports said cartons.

12. A packaging display system according to claim 11 wherein said rack comprises a plurality of shelves supporting said cartons.

13. A packaging display system according to claim 11 wherein a chart illustrating said trims is mounted on said rack.

14. A packaging display system according to claim 8 wherein said lighting fixture housings and trims form recessed lighting fixtures.

* * * * *